US007389614B2

(12) United States Patent
Sullivan

(10) Patent No.: US 7,389,614 B2
(45) Date of Patent: Jun. 24, 2008

(54) ATTIC STORAGE SYSTEM

(76) Inventor: Andrew P. Sullivan, 805 Oakdale St., Windermere, FL (US) 34786

( * ) Notice: Subject to any disclaimer, the term of this patent is extended or adjusted under 35 U.S.C. 154(b) by 293 days.

(21) Appl. No.: 10/848,300

(22) Filed: May 18, 2004

(65) Prior Publication Data

US 2005/0258722 A1 Nov. 24, 2005

(51) Int. Cl.
*E04B 1/00* (2006.01)
*G09F 7/18* (2006.01)

(52) U.S. Cl. ..... 52/202; 52/39; 52/407.3; 52/479; 52/508; 52/764

(58) Field of Classification Search ..... 52/407.3, 52/39, 202, 506.01, 508, 712, 22, 764, 480, 52/483.1, 702, 289, 762, 262, 479; 248/343, 248/247, 248, 300, 214, 215, 301, 240, 250; 312/245, 242; 211/113, 118
See application file for complete search history.

(56) References Cited

U.S. PATENT DOCUMENTS 262,415 A * 8/1882 Hubert ..... 52/479
1,217,603 A * 2/1917 Jester ..... 52/357
3,686,804 A * 8/1972 Browne ..... 52/31
4,023,323 A * 5/1977 Fortin ..... 52/712
4,122,762 A * 10/1978 Williams ..... 454/292
4,566,240 A * 1/1986 Schilger ..... 52/414
4,951,436 A * 8/1990 Burkstrand et al. ..... 52/241
5,058,352 A * 10/1991 Loiselle et al. ..... 52/404.2
5,239,790 A 8/1993 Fetzer
5,406,895 A 4/1995 Suess
5,511,353 A * 4/1996 Jones ..... 52/536
5,544,459 A * 8/1996 Konger ..... 52/220.3
5,628,153 A 5/1997 Fontanez
5,638,653 A * 6/1997 Rossi ..... 52/511
5,694,732 A * 12/1997 Wilbert ..... 52/698
6,487,825 B1 * 12/2002 Sillik ..... 52/404.1
6,622,448 B1 * 9/2003 Sonne ..... 52/656.1

* cited by examiner

*Primary Examiner*—Robert Canfield
*Assistant Examiner*—Jessie Fonseca
(74) *Attorney, Agent, or Firm*—Timothy H. Van Dyke; Beusse Wolter Sanks Mora & Maire

(57) ABSTRACT

Disclosed herein is a rack apparatus and storage panel assembly for implementing across two or more beams. The storage panel assembly is most typically implemented in attic storage space lacking a flooring surface on which to place and store items. The storage panel assembly comprises at least one rack apparatus 10, two or more railings to be positioned onto a series of rack apparatus 10 and a panel 48 configured to rest on two parallel railings 46, 44. The assembly provides a continuous platform by sitting between the truss 42 creating a planer surface between the top of the panel 48 and the top of the truss 42. The method of assembly allows positioning of the rack apparatuses 10 between the truss connections and allows the railings 46, 44 and panel 48 to slide under any transverse obstructions bearing on top of truss 42.

3 Claims, 4 Drawing Sheets

ATTIC STORAGE SYSTEM

BACKGROUND OF THE INVENTION

Storage of one's belongings is an issue of increasing concern. Over the past few decades, an entire industry dedicated to renting storage space has been developed and grown into a substantial industry. Attics have traditionally been used as storage. Typical new homes and many older homes comprise large attic spaces, e.g., space between an inner ceiling and roof of a house or a building structure, but with no structure in the attic in which to place items. Many homes simply have non-structural ceiling panels fastened to the bottom of the roof trusses with insulation provided on top of the ceiling material and no additional paneling structure on top of the trusses that could be used to place storage items. Consequently, in such houses and/or buildings there exists a vast amount of potential storage space that is not being exploited.

BRIEF DESCRIPTION OF THE DRAWINGS

FIG. 3A shows a side view of a disassembled embodiment. FIG. 3B shows a side view of an assembled embodiment with fasteners. FIG. 3C shows a perspective view of a portion of the embodiment shown in FIG. 3A or 3B demonstrating one version of how the parts interlink to achieve adjustability.

FIG. 4A shows a perspective view of a rack apparatus embodiment being positioned onto a support beam. FIG. 4B shows a perspective view of two railings being positioned onto a rack apparatus. FIG. 4C shows a panel being attached to the railings positioned on plurality of rack apparatuses disposed on two parallel support beams.

DESCRIPTION OF THE INVENTION

Figure 1:
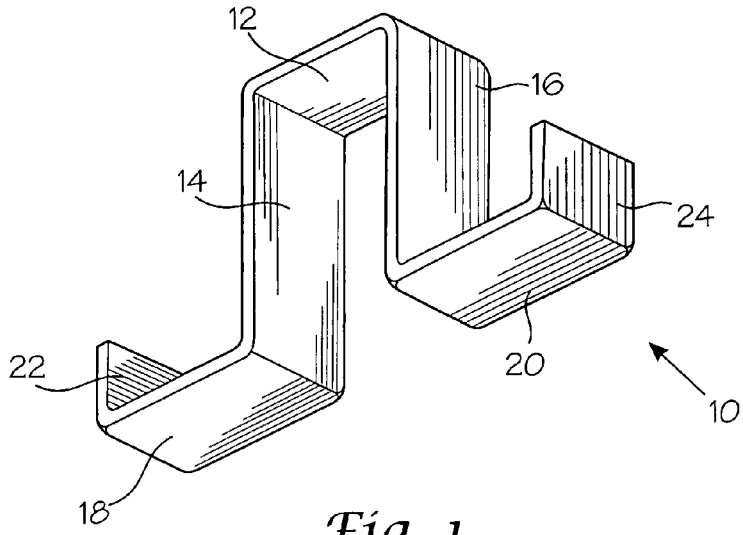
FIG. 1 shows a perspective view of a rack apparatus according to one embodiment of the subject invention.

The inventor has developed an attic storage system that is configured for easy adaptation in nearly all types of attic spaces, or other empty spaces in a house or building, that comprise a plurality of parallel trusses or similar support members. The storage system creates a structural platform to bear in between the support members and provide a top planer surface flush with the top of the truss or supporting members, hence creating a continuous platform though out the extents of the system. Referring to FIG. 1, a perspective view of a rack apparatus 10 is shown. The rack apparatus 10 comprises a base portion 12 having a first arm member 14 and a second arm member 16 extending transversely from the base portion 12. The base portion 12 and first and second arm members 14, 16, respectively, define a space that may rest upon a support structure such as a truss, or similar structure. Extending transversely from the first arm member 14 is a wing member 18. Extending from second arm member 16 is a second wing member 20. Extending transversely from the first wing member 18 is a securement member 22. Extending from the second wing member 20 is a second securement member 24. As described below, the first and second wing members and first and second securement members act together as a cradle to support a railing.

In some applications, having more than one wing member is not necessary. Accordingly, in an alternative embodiment, the rack apparatus comprises a base portion, first and second arm member and one wing member extending from one of the arm members. Typically, the wing member will comprise a securement member extending therefrom, though not required.

Figure 2:
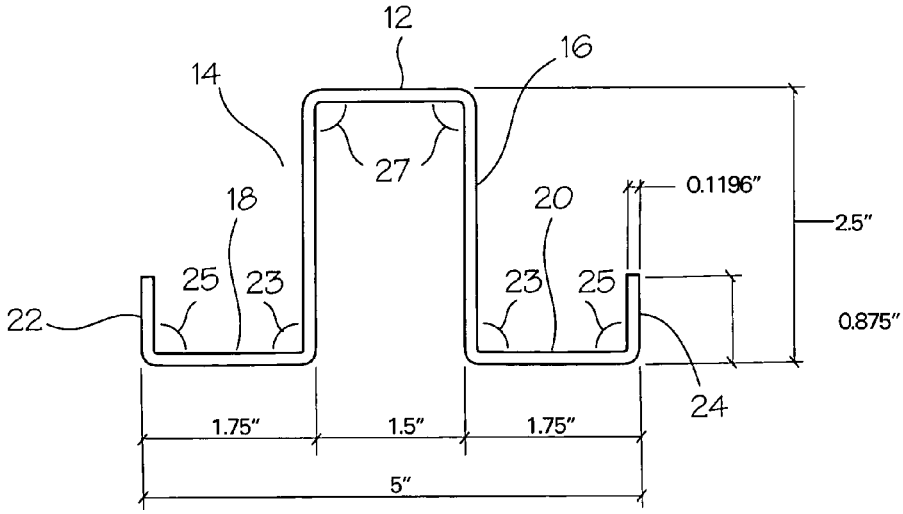
FIG. 2 shows a side view of the rack apparatus shown in FIG. 1.

FIG. 2 shows a side view of the embodiment shown in FIG. 1. First and second arm members 14, 16, respectively, form an angle 27 at the attachment or integration with the base portion 12. It is noted that the angle 27 may be in the range of between about 1° to 179°. More preferred, the angle 27 is between about 60° to 120°, and most preferred at 90°. The first and second wing members 18, 20 are attached to or integrated with the first and second arm members 14, 16, respectively, to form an angle 23. This angle 23 is typically 90° but may be between 1° to 179°. Securement members 22, 24 attached to or integrated with first and second wing members 18, 20, respectively, form angle 25. Again, the preferred angle of 25 is 90° but may be between about 1 to 179°.

As mentioned above, the rack apparatus is preferably implemented in assembling attic storage panels in conjunction with trusses in an attic space. Accordingly, in a preferred embodiment, the dimensions of the rack apparatus and in particular its specific components, is optimized for implementation with standard sized trusses. Thus, the base portion 12 is of a length in a preferred range of about 1.5 inches to about 2.5 inches. The first and second arm members 14, 16 are preferably within the range of about 0.25 to 4.25 inches in length and are specific to allow the storage panel to be planer (flush) with the top of the truss members. This can be an advantage when other objects are attached to the top of the trusses or other support structures. Thus, in a specific embodiment, the dimensions of the rack apparatus are optimized such that the panels, as will be described in detail below may lay flush with the top of the truss, or other support structure. Wing members 18, 20 are preferably of a length in the range of about 0.0625 to 3.5 inches. Securement members 22, 24 are preferably of a length in the range of about 0.25 to 1.5 inches. In a most preferred embodiment, the base portion 12 is about 1.5 inches long, arm members 14, 16 are about 2.5 inches long, wing members 18, 20 are 1.75 inches long, and securement members 22, 24 are about 0.875 inches long. Preferably, the dimensions of the base portion, arm members and wing members are configured such that panel resting on a railing disposed in said rack is about flush with the top surface of the adjacent beam or truss. The dimensions shown on FIG. 2 represent the most preferred dimensions.

Figure 3A:
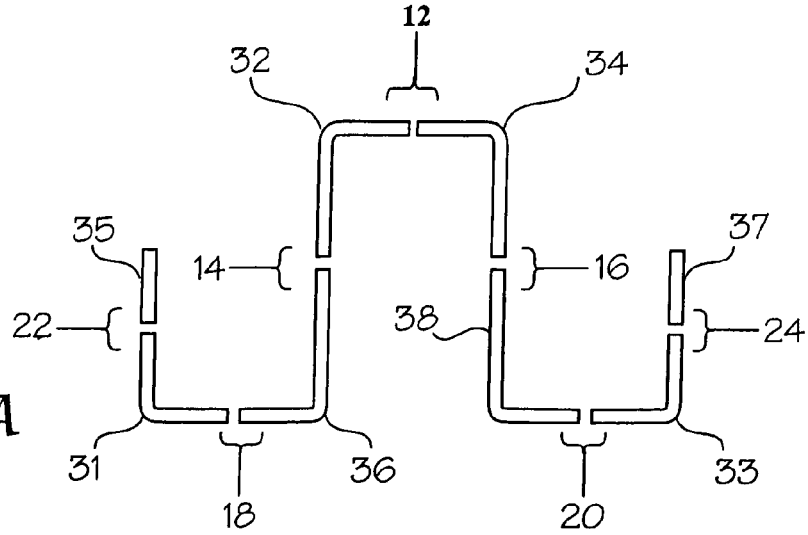
FIG. 3A-C shows an embodiment of the invention directed to a rack apparatus having adjustable components.
Figure 3B:
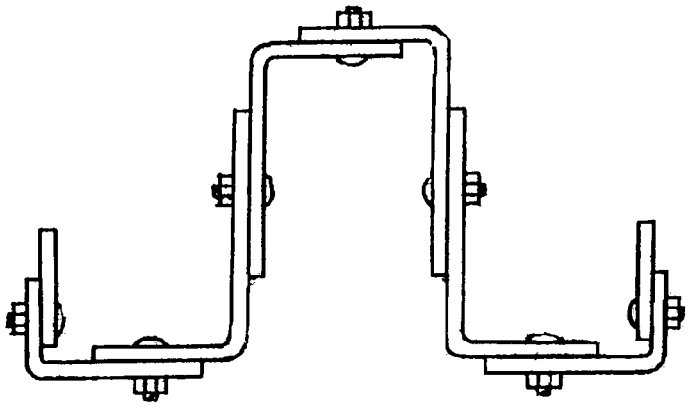
Figure 3C:
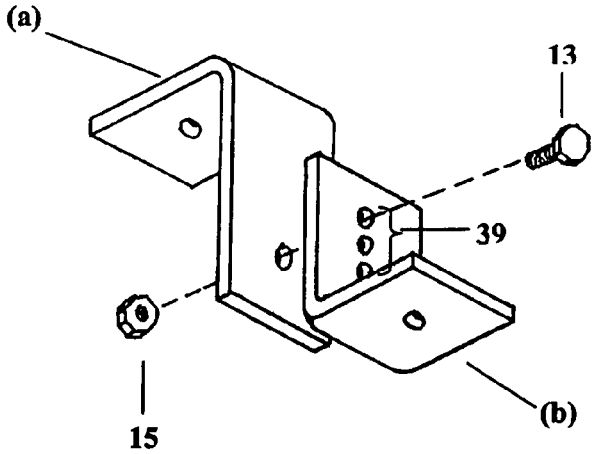

In an alternative embodiment, as shown in FIG. 3, any of the components of the rack apparatus 10 may be adjustable. FIG. 3A shows one embodiment of achieving adjustments by breaking down the individual components into two parts. The portion of the first arm member 14 and a portion of the base portion 12 are combined together into a unitary subpart 32. A portion of the second arm 16 and a portion of the base portion 12 are combined together in a unitary unit 34. A part of first arm 14 and first wing member 18 are combined together into a unitary unit 36. A part of second arm member 16 and a part of second wing member 20 are combined into a unitary structure 38. A part of wing member 18 and a part of securement member 22 are configured into a unitary member 31. A part of wing member 20 and a part of securement member 24 are configured together into a unitary structure 33. The end portion of securement members 22 and 24 is shown as 35 and 37, respectively. FIG. 3B shows the juxtaposition of the different components and subparts as described above for FIG. 3A. FIG. 3C shows a side magnified view of one juxtaposition of two subparts. The two subparts can be brought together, abutted end to end, overlapped, or secured by the provision of holes 39 wherein a screw 13, or similar fastener passes through holes 39 as they are aligned, and is tightened with a nut or other similar fastener 15 to secure the two subparts (a) and (b) together. This is simply one embodiment of how the rack apparatus can comprise one or more adjustable components. Those skilled in the art in view of the teachings herein will appreciate that numerous configurations of implementing adjustable components for the rack apparatus can be implemented, such as but not limited to, sliding mechanisms, bracket mechanisms, securing with screws, posts, pins, knobs, wing nuts, etc. Furthermore, the junction between the base portion and arm members, or arm members and wing members, or wing members and securement members may individually configured as to pivot. This would create the ability to adjust the angle to properly conform to various beams, railings etc., attach to non-level or inclined members, and provide an overall increase in flexibility to the rack apparatus. This would be especially beneficial when irregularities exist for construction materials, which is not an uncommon scenario.

Figure 4A:
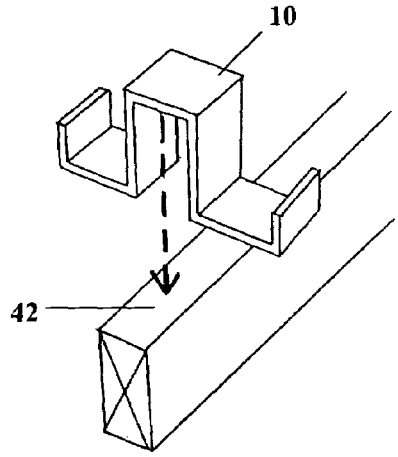
FIG. 4A-C shows another embodiment of the subject invention pertaining to a storage panel assembly that implements a rack apparatus embodiment according to one embodiment of the subject invention.
Figure 4B:
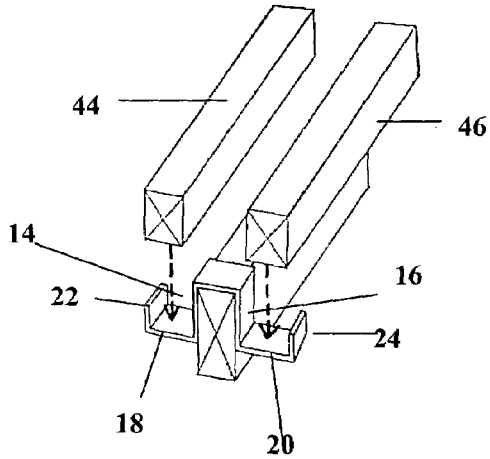
Figure 4C:
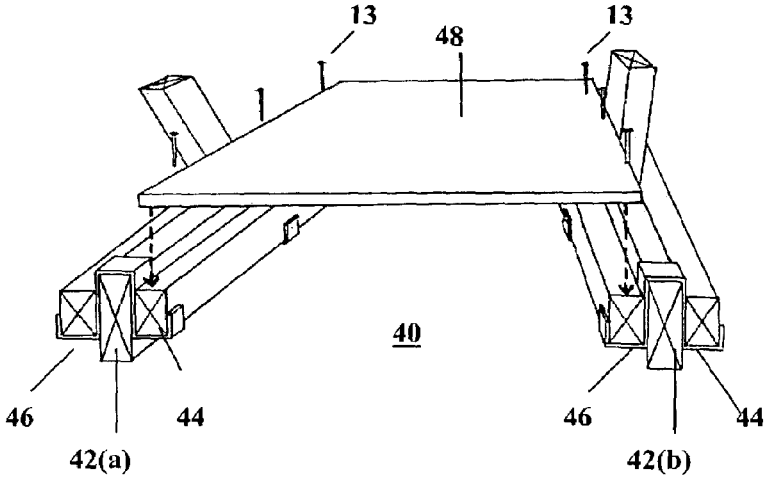

In FIG. 4A-C, there is shown a storage panel system 40 that implements the rack apparatus 10 shown in FIGS. 1-3. FIG. 4A shows the positioning of the rack apparatus 10 on top of a truss or similar type support member 42. The system 40, includes the use of railing(s) 44, 46 which are positioned and rest into the space defined by the first and second arm members 14, 16, first and second wing members 18, 20 and first and second securement members 22, 24. FIG. 4A shows a perspective view of the storage system 40 wherein two or more rack apparatuses 10 are positioned in a series along two parallel supports (trusses in this case) 42. FIG. 4B shows railings 44 and 46 resting and secured into the rack apparatus 10. FIG. 4C shows a flat panel 48 positioned on top of the railing 44 of one truss 42(*a*) and railing 46 of another truss 42(*b*) parallel to truss 42(*a*) creating a planer surface with the top of panel 48 and the tops of each truss 42(*a*) and 42(*b*). Once the panel 48 has been properly placed on top of the railings 44, 46, screws 49 or the like are attached through the panel 48 and into the rails to secure the panel 48. Those skilled in the art will appreciate that securing the panel 48 to the railings 44 and 46 is preferred, though not mandatory, and may be avoided. For example, where temporary use is desired or frequent reconfiguration of the panel assembly is desired, screws or other similar fasteners would not be used.

Figure 5:
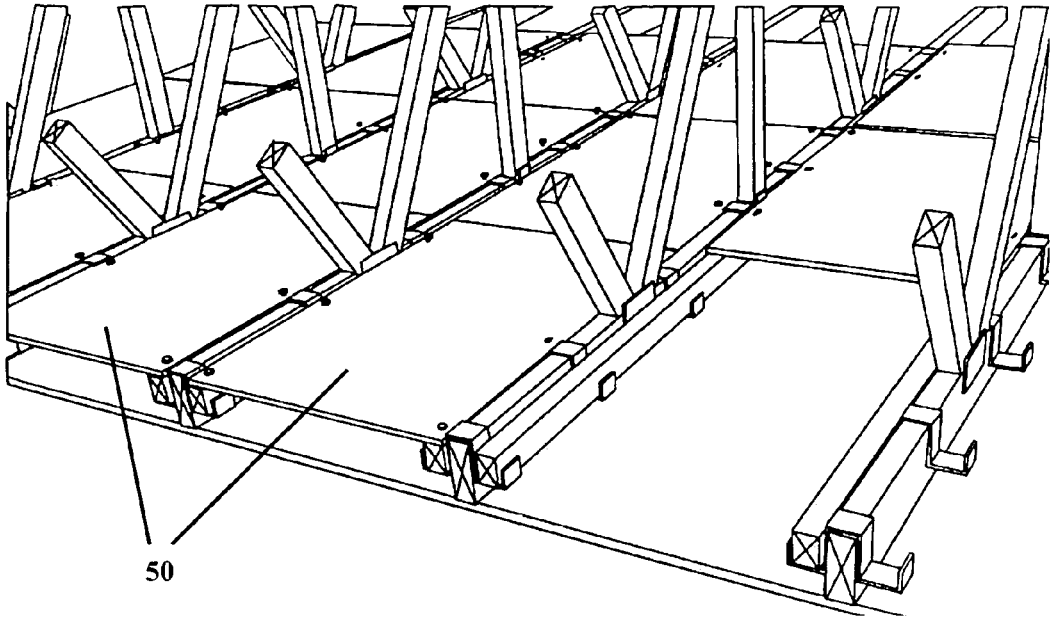
FIG. 5 shows a perspective view of a plurality of storage panel assemblies assembled in an attic space.

FIG. 5 shows a perspective view of a number of storage panel assemblies 50 as described in relation to FIG. 4. The storage panel assemblies are shown implemented in an attic space.

While various embodiments of the present invention have been shown and described herein, it will be obvious that such embodiments are provided by way of example only. Numerous variations, changes and substitutions may be made without departing from the invention herein. For example, based on the teachings herein, it will be apparent to those skilled in the art that the railings can associate with the rack apparatus in a number of different ways. Such association includes, but is not limited to, resting into, attached onto or appending from said rack apparatus. Integrating together the rack apparatuses and railing member(s) might be more appropriate where adjustments of spacing of the rack apparatuses is not required. However, given some of the various objects that are attached to trusses in an attic space, or other support structures in or not in an attic space, being able to space apart two or more apparatuses to work around such objects is typically more preferred. Furthermore, it has been described above how various components of the rack apparatus can be configured to be adjustable. The panel that is implemented with the storage panel system may also be adjustable. For example, the ends and/or sides of the panel may comprise a series of hinges such that the panel may be folded out to a desired width or length. Further, the panel may comprise a plurality of subpanels that may be connected together to form a desired width or length; the subpanels may be configured to attach together in a tongue and grove fashion. Further still, the panel may implement a more elaborate means to allow for shortening or extending in one or more planes.

The rack apparatus, railings, and/or panel may be made of any suitable material possessing the necessary resiliency and strength properties. Materials may include, but are not limited to, plastics, resins, wood, metals, or combinations thereof.

The panel may attach to the railings several different ways as will be appropriate given the specific space and application. The railings and panels may be configured for an interlinking to each other such as by a tongue and groove, or alternatively, the railing and panel may be integrated together so as to avoid the necessity for separate railing(s) and panel(s).

What is claimed is:

1. A storage panel assembly for providing a surface between two parallel support structures comprising:

a first series of at least two rack apparatuses, at least one first railing attached to or integrated with said first series of at least two rack apparatuses forming a first complex; a second series of at least two rack apparatuses; at least one second railing attached to or integrated with said second series of at least two rack apparatuses forming a second complex; and wherein said at least two rack apparatuses of said first and second series comprise a base portion; a first arm member extending in a plane transverse to the plane of said base portion; a second arm member extending in a plane transverse to the plane of said base portion; a wing member extending from said first arm member on a plane transverse to the plane of said first arm member; and a securement member extending from said wing member on a plane that is transverse to the plane of said first wing member;

wherein said railing rests on the cavity defined by said first arm member, said wing member and said securement member;

wherein said base portion is between about 1.5 to about 2.5 inches in length; said first and second arms are between about 0.25 to 4.25 inches in length; and said first and second wing members are between about 0.0625 to about 3.5 inches in length;

wherein said base portion and said first and second arm members of said at least two rack apparatuses of said first and second series define a space for fitting over support structure in an attic space;

wherein said at least two rack apparatuses of said first and second series are positioned on support structures in an attic space; and at least one panel resting on said first and second railings and of predetermined width to fit between said two parallel support structures.

2. The panel assembly of claim 1, wherein individual rack apparatuses of said first and second series, said at least one first and second railing, and said at least one panel is configured of a dimension such that said panel lays flush with the top surface of said support structures when positioned in place.

3. The panel assembly of claim 1, comprising one panel having a first edge attached to or integrated with said first complex and a second edge attached to or integrated with said second complex.

* * * * *